US006562560B1

(12) United States Patent
Broadhead et al.

(10) Patent No.: US 6,562,560 B1
(45) Date of Patent: May 13, 2003

(54) PROCESS FOR TREATMENT FOR HIGH SPEED PHOTOGRAPHIC MATERIALS

(75) Inventors: Patrick Broadhead, Parthenay (FR); Michael Christianson, Pinner (GB); Adrian J. B. Codling, Hertfordshire (GB); Roy King, Hertfordshire (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/868,761

(22) PCT Filed: Dec. 14, 1999

(86) PCT No.: PCT/GB99/04234

§ 371 (c)(1),
(2), (4) Date: Aug. 16, 2001

(87) PCT Pub. No.: WO00/38011

PCT Pub. Date: Jun. 29, 2000

(30) Foreign Application Priority Data

Dec. 22, 1998 (GB) ..... 9828152

(51) Int. Cl.[7] ..... G03C 1/025; G03C 1/035

(52) U.S. Cl. ..... 430/569; 430/422; 430/494; 430/606

(58) Field of Search ..... 430/569, 422, 430/494, 606

(56) References Cited

U.S. PATENT DOCUMENTS 5,378,599 A * 1/1995 Maskasky et al. ..... 430/569
5,672,467 A 9/1997 Buitano et al. ..... 430/567
5,928,853 A * 7/1999 Yamamoto ..... 430/569

FOREIGN PATENT DOCUMENTS

| | | |
|---|---|---|
| EP | 0 476 521 A | 3/1992 |
| EP | 0 723 189 A | 7/1996 |
| GB | 1180654 | 2/1970 |

OTHER PUBLICATIONS

P. Broadhead, "The Influence of Ionizing Radiation on the Granularity of Colour Negative Emulsions", The Imaging Science Journal, vol. 46, 1998, p. 107–118.

* cited by examiner

*Primary Examiner*—Richard L. Schilling
(74) *Attorney, Agent, or Firm*—Sarah Meeks Roberts

(57) ABSTRACT

A process for the treatment of a photographic material particularly a high speed photographic material, comprising an emulsion containing silver halide grains the treatment being to reduce the sensitivity of the material to ionizing radiation comprises prior to exposure, subjecting the material to a treatment that reduces the surface image dispersity so that fewer centers develop on each grain. The process may involve subjecting the photographic emulsion to physical pressure to deform the grains to introduce internal trapping centers for latent image formation so that a proportion of the latent image can be formed within the grains rather than on the grain surface.

4 Claims, 1 Drawing Sheet

PROCESS FOR TREATMENT FOR HIGH SPEED PHOTOGRAPHIC MATERIALS

FIELD OF THE INVENTION

This invention relates to photographic materials and to a process for reducing their sensitivity to ionising radiation.

BACKGROUND OF THE INVENTION

It is well known that photographic materials, particularly high speed photographic emulsions, are sensitive to ionising radiation. Since ionising radiation is present throughout the environment, contact with the photographic material is unavoidable.

PROBLEM TO BE SOLVED BY THE INVENTION

U.S. Pat. No. 4,264,724 describes a process for increasing the sensitivity upon exposure to light of a photographic emulsion by exposing the silver halide emulsion during preparation to an ionizing radiation. The effect is said to produce a silver halide gelatin emulsion having grains of emulsion containing in their interior sub latent image nuclei for providing sensitivity on exposure to light. However one of the effects of ionizing radiation on a photographic material between its preparation and use is premature ageing through high fog. In addition there is a significant increase in granularity that is particularly severe for color negative materials.

U.S. Pat. No. 5,096,804 discloses that silver halide emulsions sensitized by the addition of a gold sensitizing agent and a sulphur sensitizing agent are subject to fog and deterioration in graininess due to natural radiation and discloses that film having a lower total gold/silver weight ratio exhibited less fog and deterioration in graininess than films in which the ratio is higher.

U.S. Pat. No. 5,284,740 discloses that the increase in fog and decrease in sensitivity due to radiation of a silver halide color photographic light sensitive material can be mitigated by including a sulphur containing compound bearing an organic heterocyclic group.

The inventors of the present invention have found that the high granularity is caused by the dispersity of latent image over the grain surface, which results in several independently developable centres so that the grain produces an abnormally large dye cloud that is bad for granularity. This high granularity occurs at low densities near fog where it is particularly noticeable in the final image.

The present invention provides a solution to the problems of graininess and fog due to radiation by the provision of a process for treating photographic materials to reduce their sensitivity to ionising radiation.

SUMMARY OF THE INVENTION

According to the present invention there is provided a process for the treatment of a photographic material, particularly a high speed photographic emulsion, which process comprises prior to exposure, subjecting the material, to a treatment that reduces the surface image dispersity so that fewer centres develop on each grain.

ADVANTAGEOUS EFFECT OF THE INVENTION

Photographic emulsions treated in accordance with the invention have reduced granularity when subjected to ionising radiation.

DETAILED DESCRIPTION OF THE INVENTION

Figure 1:
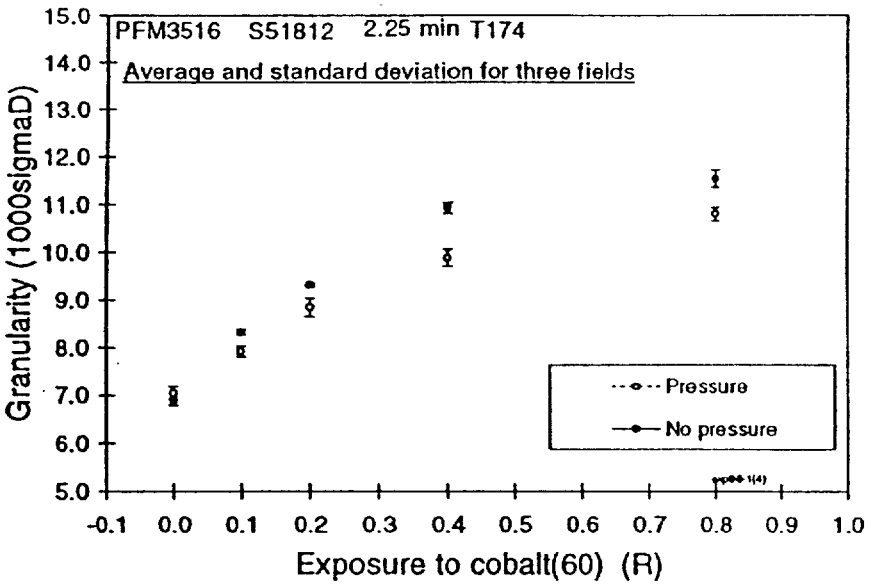
FIGS. 1 and 2 are graphs showing the variation in granularity as a function of exposure to ionising radiation for two high speed emulsions.

The terms granularity and graininess are well known in the photographic art and granularity may be measured by an instrument known as a micro densitometer.

The term internal latent image is also well known in the photographic art.

In one form of the invention the photographic emulsion is subjected to physical pressure to deform the grains to introduce internal trapping centres for latent image formation so that a proportion of the latent image can be formed within the grains rather than on the grain surface. The internal traps only function as latent image sites under conditions of high intensity encountered with an ionising radiation.

The process may be effected by introducing internal sites by physically deforming the grains or alternatively by introducing mild lattice deformities during precipitation and grain growth.

To effect the appropriate amount of deformation of the silver halide grains the pressure may be from $3\times10^9$ to $18\times10^9$, preferably from $6\times10^9$ to $12\times10^9$.N/m$^2$.

The period of time for which the pressure is applied is not critical and may conveniently be from one second to 5 minutes, preferably from 10 seconds to one minute.

The photographic material to be treated by the process of the invention may be a silver halide color negative material, particularly one having a speed above 400 ASA or above 1000 ASA.

Typically, the material may comprise at least one red sensitive silver halide emulsion layer, at least one green sensitive silver halide emulsion layer and at least one blue sensitive silver halide emulsion layer on a support.

At least one of the layers may contain silver iodide, for example in an amount of not less than 12 mol %. The photographic materials may be any of those described in U.S. Pat. Nos. 5,284,740; 5,096,804 and 4,692,401 which are included by reference.

The invention is illustrated by the following Examples.

EXAMPLE 1

High speed emulsions used were Kodak (Registered Trade Mark) PFM 3528 and PFM 3516 which are high speed green sensitive emulsions of speeds 1000 and 800 respectively.

PFM 3528 is a generic 1.5% run iodide, 2% dump iodide polydisperse fast magenta AgBrI tabular grain emulsion of thickness 0.15 micrometers.

PFM 3516 is a CAKI emulsion 3.60% iodide of thickness 0.14 micrometers.

The film strips were subjected to pressure before exposure using a Mark II Abrasion Sensitometer.

The film strip was clamped to the circumference of a 10 cm diameter wheel with the emulsion side in contact with the rubberised surface. The wheel rotated whilst pressure was applied over the whole length of the 12 inch film strip by a stylus (diameter of tip approximately 10 micrometers). The stylus was displaced by approximately 9 micrometers after each revolution so that, in essence, over a 2 minute period a raster pattern was drawn on the film strip giving a pressured area of about 9 mm wide. The stylus applied pressure through the back of the coating in order to smooth out the pressure pattern across the width of the film strip so that the raster pattern would not interfere with measurements of granularity.

Preliminary tests indicated that pressures of 50 g gave no noticeable change in sensitometric curve shape and pressures of 150 g gave a small decrease in contrast and Dmax and a small increase in fog density.

The films were either exposed to light via a step wedge for 0.01s on the DF sensitometer or exposed uniformly to cobalt (60) radiation at the National Radiological Protection Board to give a control strip with zero exposure and several strips with radiation exposures up to Emax=0.8R. The films were processed in the Kodak T 174 (Registered Trade Mark) process to give a dye image and all the film samples relating to a particular coating were processed simultaneously for both types of exposure to minimise processing variability. Data shown for pressure areas were always taken from the same film strip to avoid processing and silver laydown uncertainties.

The dye densities were measured on the SPADE densitometer and the granularities were measured as a fluctuation in the dye density (ie sigma D) using the LEITZ granularity instrument. The latter used a 48 micron diameter circular aperture and 2000 data points and in this Report the granularity values relate to 1000*sigmaD.

The data for a single measurement were obtained from an area approximately 1 mm wide across the width of the film strip and 5 mm long and measurements were made every 110 mm along the length of the film strip, which corresponded with the steps of the wedge. In the case of the cobalt (60) exposures, where a wedge was not used, the same procedure was adopted and the multiple measurements offered an improvement in confidence. A investigation of the effect that the pressure had on the granularity was carried out by making several measurements across the film strip at distances of 1 to 2 mm apart for every exposure step, for every unpressured area and for every pressured area. The SPADE and the LEITZ instruments used a blue coloured filter to suit the yellow coupler dye and all densities were corrected by removing a base density of 0.02.

Figure 2:
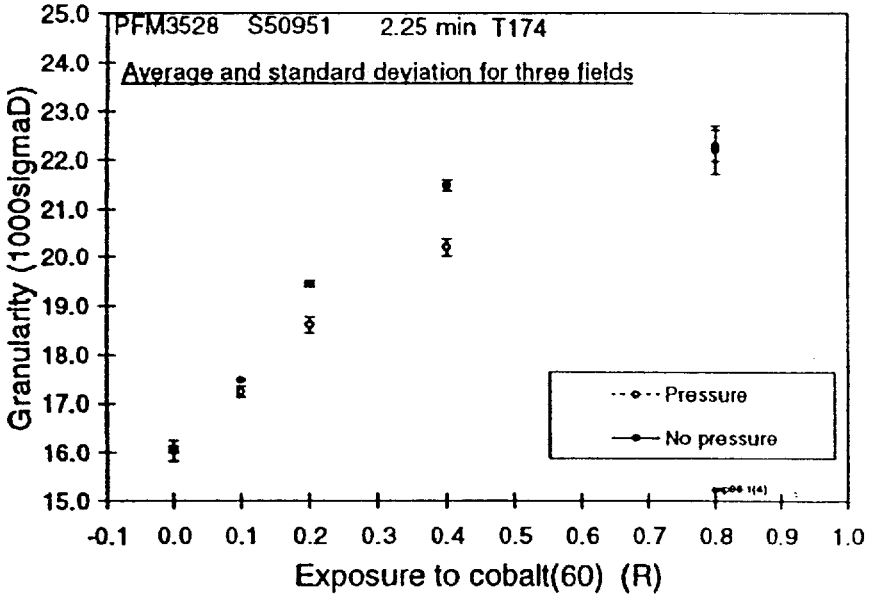

Referring to FIGS. 1 and 2: these are graphs showing the variation of granularity for the two high speed emulsions PFM 3516 and PFM 3528.

The granularity is shown as a function of the exposure go to ionising radiation for areas of film that were either given no pressure or given a load of 100 g. The average values and the standard deviations are shown.

The results show that the emulsion which had been subjected to the pressure treatment had a lower granularity on exposure to cobalt (60) that the one that had not been treated.

What is claimed is:

1. A process for reducing the sensitivity to ionizing radiation of a photographic material comprising an emulsion containing silver halide grains, which process comprises, prior to exposure, subjecting the material to a treatment that reduces the surface dispersity so that fewer centres develop on each grain, the treatment comprising subjecting the photographic emulsion to the application of physical pressure from $3\times10^9$ to $18\times10^9 N/m^2$ to effect deformation of the grains such that internal trapping centres for latent image formation are introduced so that a proportion of the latent image can be formed within the grains.

2. A process as claimed in claim 1 wherein the photographic material is a high speed photographic emulsion having a speed of at least 400 ASA.

3. A process as claimed in claim 1 wherein the photographic material is a silver halide color negative material having a speed of at least 1000 ASA.

4. A process as claimed in claim 1 wherein the pressure applied to the photographic emulsion to effect the deformation of the grains is from $6\times10^9$ to $12\times10^9 N/m^2$.

* * * * *